United States Patent [19]

Kimura et al.

[11] Patent Number: 4,565,948

[45] Date of Patent: Jan. 21, 1986

[54] FLUORESCENT LAMP

[75] Inventors: Yoshio Kimura, Yokohama; Kenji Terashima, Chigasaki; Masao Asada; Satoshi Sugano, both of Yokohama, all of Japan

[73] Assignee: Tokyo Shibaura Denki Kabushiki Kaisha, Japan

[21] Appl. No.: 474,581

[22] PCT Filed: Jun. 18, 1982

[86] PCT No.: PCT/JP82/00234

§ 371 Date: Feb. 16, 1983

§ 102(e) Date: Feb. 16, 1983

[87] PCT Pub. No.: WO82/04439

PCT Pub. Date: Dec. 23, 1982

[30] Foreign Application Priority Data

Jun. 18, 1981 [JP] Japan ..... 56-93033

[51] Int. Cl.[4] ..... H01J 1/63

[52] U.S. Cl. ..... 313/487; 252/301.4 R; 252/301.4 F; 252/301.4 P

[58] Field of Search ..... 252/301.4 F, 301.4 P, 252/301.4 R; 313/487

[56] References Cited

U.S. PATENT DOCUMENTS 3,481,884 12/1969 Palilla et al. ..... 252/301.4 P
4,151,443 4/1979 Van den Boom et al. ... 252/301.4 F X
4,208,611 6/1980 Watanabe et al. ..... 252/301.4 F X

FOREIGN PATENT DOCUMENTS 67030 12/1982 European Pat. Off. .
2534834 2/1976 Fed. Rep. of Germany ... 252/301.4 P
2935711 3/1980 Fed. Rep. of Germany .
54-68784 6/1979 Japan ..... 252/301.4 P
55-52378 4/1980 Japan ..... 252/301.4 F

*Primary Examiner*—Jack Cooper
*Attorney, Agent, or Firm*—Cushman, Darby & Cushman

[57] ABSTRACT

A fluorescent lamp having a phosphor film comprising:

a blue-emitting phosphor consisting essentially of at least one divalent europium activated haloborophosphate phosphor having the general formula:

$$x(M_{1-p}.Eu_p.O).yP_2O_5.aM'X_2.bB_2O_3$$

wherein M and M' are independently at least one of Sr, Ca and Ba; X is at least one of Cl, F and Br; and $2.7 \leqq x \leqq 3.3$, $0.50 \leqq y \leqq 1.50$, $0.10 \leqq a \leqq 0.50$, $0.01 \leqq b \leqq 0.50$, and $0.001 \leqq p \leqq 0.20$;

a green-emitting phosphor consisting essentially of a cerium and terbium activated silicophosphate phosphor of the general formula:

$$(Re_{1-c-d-3e}Tb_cCe_dA_{3e})_2O_3.qP_2O_5.rSiO_2$$

wherein Re is at least one of Y, La and Gd; A is at least one of Li, Na, K, Rb, and Cs; and $0<c$, $0<d$, $5\times10^{-2} \geqq e \geqq 1\times10^{-5}$, $0<c+d+3e<1$, $0<q$, and $0<r$; and a red-emitting phosphor consisting essentially of a trivalent europium activated yttrium oxide phosphor having the general formula $(Y, Eu)_2O_3$.

1 Claim, 3 Drawing Figures

FLUORESCENT LAMP

TECHNICAL FIELD

The present invention relates to an improvement in a fluorescent lamp.

BACKGROUND ART

The three peak emission system is known as one of the methods for improving color rendering properties of a fluorescent lamp without impairing its efficacy. In other words, it is known to use three types of phosphors which have light emission spectra with peaks in the vicinities of 450 nm, 540 nm and 610 nm, respectively, and with relatively narrow half value width.

Phosphors which may be conveniently used by the above-mentioned three peak emission system may include a europium activated divalent strontium.calcium chlorophosphate phosphor as a blue-emitting phosphor having a peak of the spectrum in the vicinity of 450 nm, a cerium and terbium activated yttrium silicate phosphor as a green-emitting phosphor having a peak of the spectrum in the vicinity of 540 nm, and a europium activated yttrium oxide phosphor as a red-emitting phosphor having a peak of the spectrum in the vicinity of 610 nm.

When the lamp ambient temperature becomes low, the starting voltage of the lamp generally becomes high. Therefore, when a lamp is used in a cold area or at a position where it is subject to cool temperatures, the starting voltage is an important problem. When the starting voltage becomes higher than the commercial supply voltage, the lamp cannot be turned on. In a general fluorescent lamp, the practical starting voltage must be a voltage about 10% lower than the commercial supply voltage for the purpose of preventing non-starting of the lamp if the lamp ambient temperature is 21° C. Therefore, when the commercial voltage is 100 V, the practical starting voltage must be 90 V or lower.

In a fluorescent lamp of the three wavelength method which uses as blue, green and red-emitting phosphors a europium activated divalent strontium.calcium chlorophosphate, a cerium and terbium activated yttrium silicate phosphor, and a europium activated yttrium oxide phosphor, the starting voltage becomes high and frequently exceeds 90 V, thus limiting the installation location of the lamp.

DISCLOSURE OF INVENTION

The applicant of the present invention has succeeded in synthesizing a novel blue-emitting phosphor (to be referred to as phosphor I hereinafter) in which the light output is 30% improved over that of a divalent europium activated strontium.calcium chlorophosphate phosphor, and which is covered by Japanese Patent Application No. 55-183939.

The phosphor I is a divalent europium activated haloborophosphate blue phosphor and has the general formula:

$$x(M_{1-p}.Eu_p.O).yP_2O_5.aM'X_2.bB_2O_3$$

wherein M and M' are independently at least one of strontium, calcium, and barium; X is at least one of chlorine, fluorine, and bromine; and $2.7 \leqq x \leqq 3.3$, $0.50 \leqq y \leqq 1.5$, $0.10 \leqq a \leqq 0.50$, $0.01 \leqq b \leqq 0.50$, and $0.001 \leqq p \leqq 0.20$.

The applicant of the present invention has also succeeded in synthesizing a novel green-emitting phosphor (to be referred to as phosphor II hereinafter) in which the decrease in the light output after some ON time is improved over that of a cerium and terbium activated yttrium silicate green-emitting phosphor and in which the light output itself is also significantly improved.

The phosphor II is a cerium and terbium activated silicophosphate green-emitting phosphor having the general formula:

$$(Re_{1-c-d-3e}Tb_cCe_dA_{3e})_2O_3.qP_2O_5.rSiO_2$$

wherein Re is at least one of yttrium, lanthanum, and gadolinium; A is at least one alkaline metal; and $0<c$, $0<d$, $5\times10^{-2} \geqq e \geqq 1\times10^{-5}$, $0<c+d+3e<1$, $0<q$, and $0<r$.

The peak wavelength of the spectrum of the phosphor I is in the vicinity of 452 nm, while that of the phosphor II is in the vicinity of 543 nm. When these phosphors are used as the fluorescent lamp of the three wavelength type, that is, for example, at least one of the phosphor I and divalent europium activated chlorophosphate is used as the blue-emitting phosphate, the phosphor II is used as the green-emitting phosphor, and a europium activated yttrium oxide phosphor represented by the general formula $(Y, Eu)_2O_3$ is used as the red-emitting phosphor, the starting voltage of the fluorescent lamp is found to be lowered. The present invention has been established based on this finding.

Thus, the present invention provides a fluorescent lamp with lower starting voltage of the three peak emission type. The fluorescent lamp of the present invention is characterized:

(1) by comprising a phosphor film consisting of:

a blue-emitting phosphor comprising at least one of a divalent europium activated chlorophosphate phosphor having a composition of the general formula $3(M, Eu)_3.(PO_4)_2.M'Cl_2$ wherein M and M' are independently at least one of strontium, calcium and barium; and a divalent europium activated haloborophosphate phosphor (I) having the general formula:

$$x(M_{1-p}.Eu_p.O).yP_2O_5.aM'X_2.bB_2O_3$$

wherein M and M' are independently at least one of strontium, calcium and barium; X is at least one of chlorine, fluorine and bromine; and $2.7 \leqq x \leqq 3.3$, $0.50 \leqq y \leqq 1.5$, $0.10 \leqq a \leqq 0.50$, $0.01 \leqq b \leqq 0.50$, and $0.001 \leqq p \leqq 0.20$;

a green-emitting phosphor comprising a cerium and terbium activated silicophosphate phosphor (II) of the general formula:

$$(Re_{1-c-d-3e}Tb_cCe_dA_{3e})_2O_3.qP_2O_5.rSiO_2$$

wherein Re is at least one of yttrium, lanthanum and gadolinium; A is at least one of lithium, sodium, potassium, rubidium, and cesium; and $0<c$, $0<d$, $5\times10^{-2} \geqq e \geqq 1\times10^{-5}$, $0<c+d+3e<1$, $0<q$, and $0<r$; and a red-emitting phophor comprising a trivalent europium activated yttrium oxide phosphor having the general formula $(Y, Eu)_2O_3$; and (2) in that the phosphor film consists of 1 to 38% by weight of the blue-emitting phosphor, 13 to 73% by weight of the green-emitting phosphor and 15 to 65% by weight of the red-emitting phosphor based on 100% by weight of the total weight of the respective phosphors.

A starting voltage at 21° C. of a 20 W fluorescent lamp for a commercial voltage of 100 V and having the phosphor film as described above was found to be generally 88 V or less in contrast to 95 V of a conventional fluorescent lamp using a divalent europium activated strontium.calcium chlorophosphate as the blue-emitting phosphor, a cerium and terbium activated yttrium silicate phosphor as the green-emitting phosphor, and a europium activated yttrium oxide as the red-emitting phosphor.

BEST MODE OF CARRYING OUT THE INVENTION

In order to prepare an excellent phosophor I as the blue-emitting phosphor of the present invention, various raw material compounds are used such as secondary phosphates, carbonates, chlorides, fluorides, bromides and oxides of strontium, calcium and barium; oxide, carbonate and fluoride of europium; boric acid; boron oxide; and the like. Compounds which form a phosphor composition at high temperatures may be used in place of these raw material compounds.

The raw material compounds are mixed and are calcined in a reducing atmosphere such as a gas mixture of 95% by volume of nitrogen and 5% by volume of hydrogen at a temperature of about 900° to 1,200° C. and preferably at a temperature of 1,000° to 1,150° C. for 1 to 4 hours. The calcined body is pulverized, is rinsed with cold water or warm water to remove the unreacted material, and is dried.

In order to perform the reaction satisfactorily, the resultant powder may be calcined again at a temperature of 900° to 1,200° C. and, particularly, 1,000° to 1,150° C.

Figure 1:
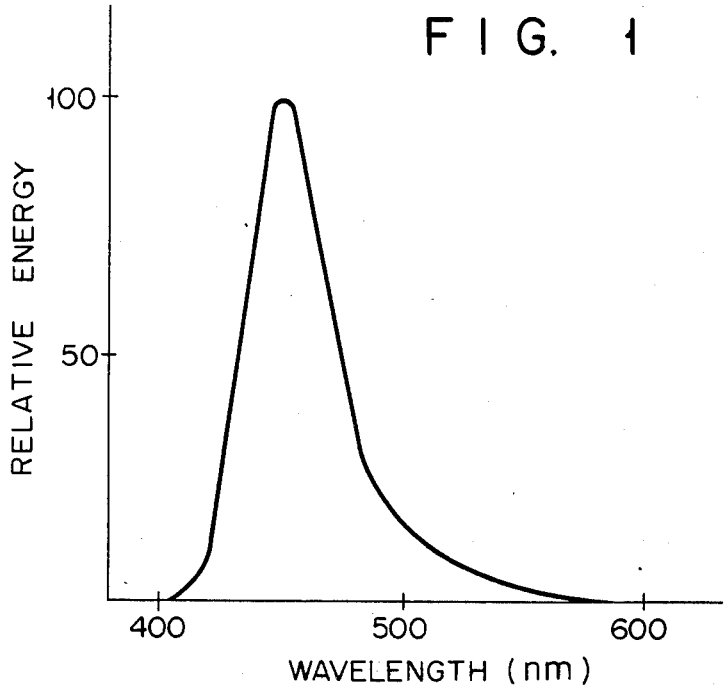
FIG. 1 is a graph showing an example of a light emission spectrum of a blue-emitting phosphor used in a fluorescent lamp of the present invention.

The light emission spectrum of the phosphor I obtained in this manner having, for example, the general formula:

$$3(Sr_{0.98}Eu_{0.92}O)0.92P_2O_5.0.33CaCl_2.0.08B_2O_3$$

is shown in FIG. 1. The peak appears in the vicinity of 452 nm, the half value width is small, and the color purity is good. Therefore, when the phosphor is used for a fluorescent lamp of the three peak emission type, the phosphor provides good lamp characteristics.

In order to prepare the phosphor II as the green-emitting phosphor of the present invention, various raw material compounds are used such as oxides, chlorides, carbonates, and phosphates of yttrium, lanthanum, gadolinium, terbium and cerium; halides and phosphates of alkaline metals; oxides, carbonates, hydroxides and phosphates of silicon; diammonium phosphates; phosphorus pentoxides; and the like. Compounds which form a phosphor composition at high temperatures may be used in place of these raw material compounds. The raw material compounds are mixed and a suitable amount of carbon powder is placed on the mixture. Calcination is performed at a temperature of about 1,100° to 1,500° C. and preferably of 1,200° to 1,350° C. for 2 to 5 hours in an atmosphere of nitrogen. The carbon powder is then removed, and calcination is performed again at a temperature of about 1,200° to 1,350° C. for 2 to 5 hours in a reducing atmosphere such as a gas mixture consisting of 95% by volume of nitrogen and 5% by volume of hydrogen. The calcined body is pulverized.

Figure 2:
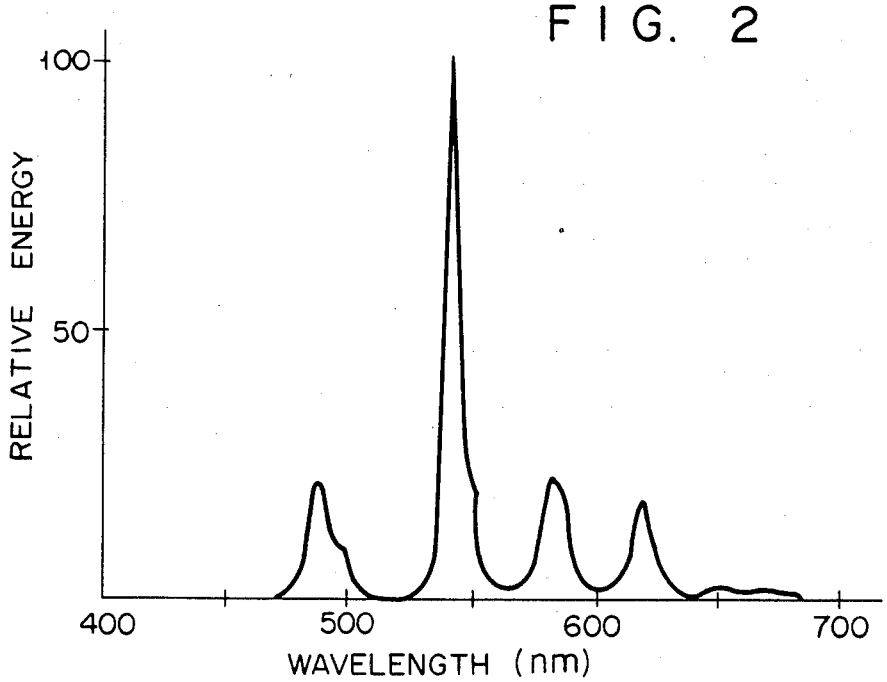
FIG. 2 is a graph showing an example of a light emission spectrum of a green-emitting phosphor used in a fluorescent lamp of the present invention.

The spectrum distribution of the resultant phosphor II having the general formula $(La_{0.1}Tb_{0.2}Ce_{0.697}Li_{0.003})_2O_3.0.9P_2O_5.0.2SiO_2$ is shown in FIG. 2. The phosphor has a peak in the vicinity of 543 nm and shows a line spectrum which is suitable for a green-emitting phosphor for a fluorescent lamp of the three peak emission type.

In a fluorescent lamp of the three peak emission type, the color temperature of the emitted light is 2,800 to 7,000 K. Performance of a high color rendering property fluorescent lamp must be such that the average color rendering index (Ra) is 80 or more and the lamp efficacy is 80 lm/W or more. In order to provide a fluorescent lamp with such performance, the mixing ratio of the blue, green and red phosphors must be 1 to 38% by weight of the blue-emitting phosphor, 13 to 73% by weight of the green-emitting phosphor, and 15 to 65% by weight of the red-emitting phosphor, and that the total amount of the phosphors must amount to 100% by weight.

The present invention will now be described in more detail by way of its examples.

EXAMPLE 1

Using 19% by weight of $3(Sr_{0.98}Eu_{0.02}O)0.92P_2O_5.0.33CaCl_2.0.08B_2O_3$ as the blue-emitting phosphor I, 44% by weight of $(La_{0.1}Tb_{0.2}Ce_{0.697}Li_{0.003})_2O_3.0.9P_2O_5.0.2SiO_2$ as the green-emitting phosphor, and 37% by weight of a europium activated yttrium oxide phosphor $(Y_{0.95}Eu_{0.05})_2O_3$ as the red-emitting phosphor, a white fluorescent lamp of 5,000 K and of 19 W was prepared by the conventional method. The starting voltage of the resultant lamp was measured.

As a Comparative Example, a white fluorescent lamp of 5,000 K and of 19 W was used which consisted of a europium activated divalent strontium.calcium chlorophosphate blue-emitting phosphor, a cerium and terbium activated yttrium silicate green-emitting phosphor, and a europium activated yttrium oxide red-emitting phosphor.

Figure 3:
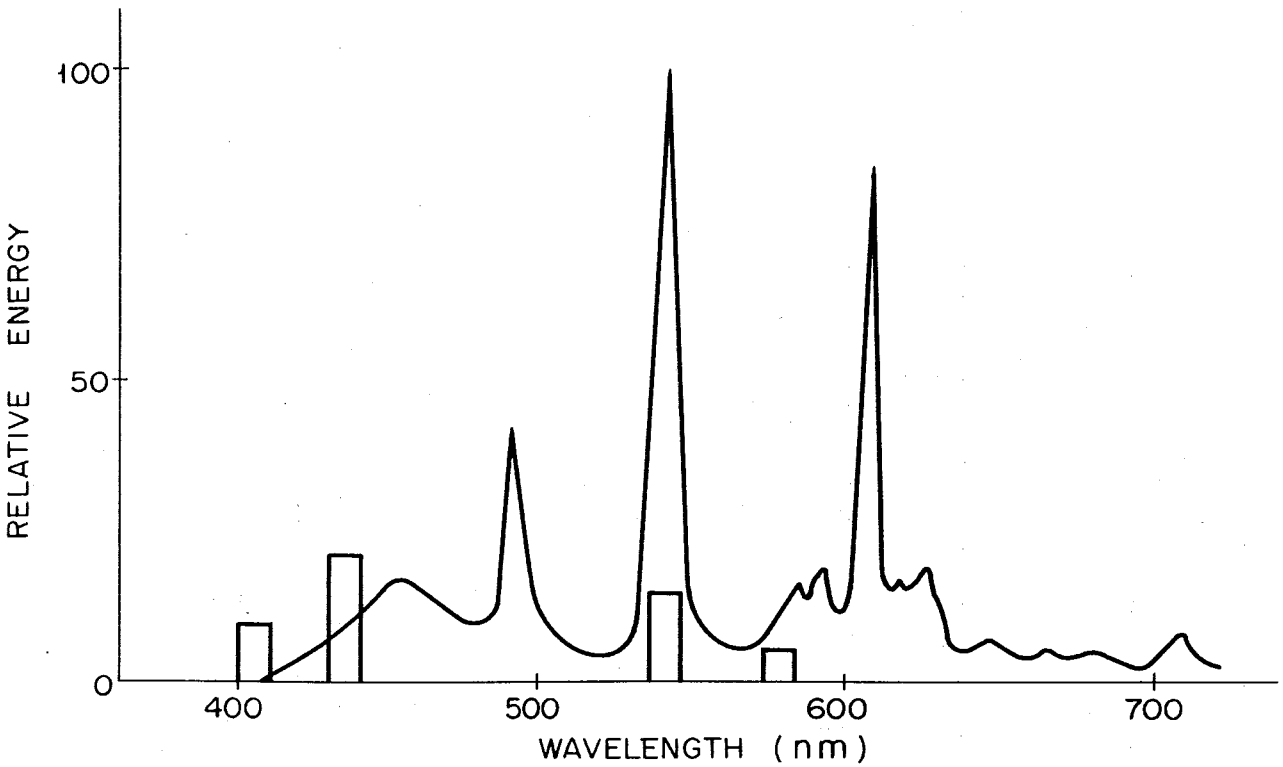
FIG. 3 is a graph showing an example of a light emission spectrum of a fluorescent lamp according to an embodiment of the present invention.

FIG. 3 shows the light emission spectrum distribution of the fluorescent lamp of this example in the initial ON period.

The fluorescent lamp of the Comparative Example had a starting voltage of 95 V, while the fluorescent lamp of the Example was 85 V, providing a 10.5% improvement.

The average color rendering index (Ra) was 85 and the lamp efficacy was 92 lm/W in the initial ON period. A fluorescent lamp manufactured by using only the green phosphor used in this Example had a starting voltage of 96 V.

EXAMPLE 2

Using 22% by weight of $2.9(Sr_{0.95}Ca_{0.01}Ba_{0.02}Eu_{0.02}O)0.85P_2O_5.0.5CaCl_2.0.12B_2O_5$ as the blue-emitting phosphor I, 42% by weight of $(La_{0.61}Ce_{0.1}Tb_{0.2}K_{0.09}$-

$)_2O_3.0.95P_2O_5.0.1SiO_2$ as the green-emitting phosphor, and 36% by weight a europium activated yttrium oxide phosphor as the red-emitting phosphor, a daylight fluorescent lamp of 6,500 K and of 19 W was manufactured by the conventional method. The starting voltage of the resultant lamp was measured.

As a Comparative Example, a daylight fluorescent lamp of 6,500 K and of 19 W was used which consisted of a divalent europium activated strontium.calcium chlorophosphate blue-emitting phosphor, a cerium and terbium activated yttrium silicate green-emitting phosphor, and a europium activated yttrium oxide red-emitting phosphor.

The fluorescent lamp of the Comparative Example had a starting voltage of 95 V, while the fluorescent lamp of this Example had a starting voltage of 86 V, providing an improvement of 9.5%. The average color rendering index (Ra) was 82 and the lamp efficacy was 90 lm/W in the initial ON period.

EXAMPLE 3

Using 18% by weight of $2.8(Sr_{0.90}Ba_{0.08}Eu_{0.02}O)$-$0.90P_2O_5.0.30(Ca_{0.5}Sr_{0.5})Cl_2.0.05B_2O_3$ as the blue-emitting phosphor, 41% by weight of $(La_{0.50}Y_{0.11}$-$Ce_{0.178}Tb_{0.21}Na_{0.002})_2O_3.0.8P_2O_5.0.4SiO_2$ as the green-emitting phosphor, and 41% by weight of a europium activated yttrium oxide phosphor as the red-emitting phosphor, a white fluorescent lamp of 4,200 K and of 19 W was manufactured by the conventional method, and a starting voltage of the lamp was measured.

As a Comparative Example, a white fluorescent lamp of 4,200 K and of 19 W was used which consisted of a divalent europium activated strontium.calcium chlorophosphate blue-emitting phosphor, a cerium and terbium activated yttrium silicate green-emitting phosphor, and a europium activated yttrium oxide red-emitting phosphor.

The fluorescent lamp of the Comparative Example had a starting voltage of 95 V, while the fluorescent lamp of this Example had a starting voltage of 84 V to provide an improvement of 11.6%. The average color rendering index (Ra) was 85 and the lamp efficacy was 93 lm/W in the initial ON period.

EXAMPLE 4

Using 15% by weight of $2.7(Sr_{0.85}Ca_{0.13}Eu_{0.20}O)$-$0.95P_2O_5.0.40Ca(Cl_{1.9}F_{0.1})0.3B_2O_3$ as the blue-emitting phosphor, 42% by weight of $(La_{0.12}Ce_{0.62}Tb_{0.25}K_{0.01}$-$)_2O_3.0.9P_2O_5.0.2SiO_2$ as the green-emitting phosphor, and 43% by weight of a europium activated yttrium oxide phosphor as the red-emitting phosphor, a warm white fluorescent lamp of 3,500 K and of 19 W was manufactured by the conventional method. The starting voltage of the resultant lamp was measured.

As a Comparative Example, a warm white fluorescent lamp of 3,500 K and of 19 W was used which consisted of a divalent europium activated strontium.calcium chloro-phosphate blue-emitting phosphor, a cerium and terbium activated yttrium silicate green-emitting phosphor, and a europium activated yttrium oxide red-emitting phosphor.

The fluorescent lamp of the Comparative Example had a starting voltage of 95 V, while that of the Example had a starting voltage of 85 V, thus providing an improvement of 10.5%. The average color rendering index (Ba) was 85 and the lamp efficacy was 95 lm/W in the initial ON period.

EXAMPLE 5

Using 10% by weight of $2.9(Sr_{0.7}Ba_{0.25}Eu_{0.05}O)$-$0.9P_2O_5.0.20CaCl_2.0.4B_2O_3$ as the blue-emitting phosphor, 44% by weight of $(La_{0.1}Ce_{0.69}Tb_{0.2}Cs_{0.01}$-$)_2O_3.0.9P_2O_5.0.2SiO_2$ as the green-emitting phosphor, and 46% by weight of a europium activated yttrium oxide phosphor as the red-emitting phosphor, a warm white fluorescent lamp of 3,000 K and of 19 W was manufactured by the conventional method. The starting voltage of the resultant lamp was measured.

As a Comparative Example, a warm white fluorescent lamp of 3,000 K and of 19 W was used which consisted of a divalent europium activated strontium.-calcium chlorophosphate blue-emitting phosphor, a cerium and terbium activated yttrium silicate green-emitting phosphor, and a europium activated yttrium oxide red-emitting phosphor.

The fluorescent lamp of the Comparative Example had a starting voltage of 95 V, while that of this Example had a starting voltage of 88 V, thus providing an improvement of 7.4%. The average color rendering index (Ra) was 85 and the lamp efficacy was 97 lm/W in the initial ON period.

EXAMPLE 6

Using 26% by weight of $3(Sr, Eu)_3(PO_4)_2$ .(Ca, Sr)$Cl_2$ as the blue-emitting phosphor, 41% by weight of $(La_{0.1}Ce_{0.5}Tb_{0.3}Li_{0.1})_2O_3.0.95P_2O_5.0.1SiO_2$ as the green-emitting phosphor, and 33% by weight of a europium activated yttrium oxide phosphor as the red-emitting phosphor, a color matching fluorescent lamp of 6,500 K and of 19 W was manufactured by the conventional method. The firing potential of the resultant lamp was measured.

As a Comparative Example, a daylight fluorescent lamp was used which consisted of a divalent europium activated strontium.calcium chlorophosphate blue-emitting phosphor, a cerium and terbium activated yttrium silicate green-emitting phosphor, and a europium activated yttrium oxide red-emitting phosphor.

The fluorescent lamp of the Comparative Example had a starting voltage of 95 V, while that of the Example had a starting voltage of 86 V, thus providing an improvement of 9.5%. The average color rendering index (Ra) was 82 and the lamp efficiency was 88 lm/W in the initial ON period.

We claim:

1. A fluorescent lamp having a phosphor film comprising:

a blue-emitting phosphor consisting essentially of at least one of a divalent europium activated chlorophosphate phosphor having a general formula $3(M, Eu)_3(PO_4)_2.M'Cl_2$ wherein M and M' are independently at least one of strontium (Sr), calcium (Ca) and barium (Ba); and a divalent europium activated haloborophosphate phosphor having a general formula:

$$x(M_{1-p}.Eu_p.O).yP_2O_5.aM'X_2.bB_2O_3$$

wherein M and M' are independently at least one of strontium (Sr), calcium (Ca) and barium (Ba); X is at least one of chlorine (Cl), fluorine (F) and bromine (Br); and $2.7 \leqq x \leqq 3.3$, $0.50 \leqq y \leqq 1.50$, $0.10 \leqq a \leqq 0.50$, $0.01 \leqq b \leqq 0.50$, and $0.001 \leqq p \leqq 0.20$;

a green-emitting phosphor consisting essentially of a cerium and terbium activated silicophosphate phosphor of a general formula:

$$(Re_{1-c-d-3e}Tb_cCe_dA_{3e})_2O_3.qP_2O_5.rSiO_2$$

wherein Re is at least one of yttrium (Y), lanthanum (La) and gadolinium (Gd); A is at least one of lithium (Li), sodium (Na), potassium (K), rubidium (Rb), and cesium (Cs); and $0<c$, $O<d$, $5\times10^{-2}\geqq e\geqq1\times10^{-5}$, $0<c+d+3e<1$, $0<q$, and $0<r$; and a red-emitting phosphor consisting essentially of a trivalent europium activated yttrium oxide phosphor having a general formula $(Y, Eu)_2O_3$, wherein the phosphor film comprises 1 to 38% by weight of the blue-emitting phosphor, 13 to 73% by weight of the green-emitting phosphor and 15 to 65% by weight of the red-emitting phosphor based on 100% by weight of a total weight of the phosphors, and wherein said lamp exhibits a starting voltage at 21° C. of 88 V or less.

* * * * *

UNITED STATES PATENT AND TRADEMARK OFFICE

CERTIFICATE OF CORRECTION

PATENT NO. : 4,565,948

DATED : January 21, 1986

INVENTOR(S) : Yoshio KIMURA, Kenji TERASHIMA, Masao ASADA, Satoshi SUGANO

It is certified that error appears in the above-identified patent and that said Letters Patent is hereby corrected as shown below:

On the title page

Change "[73] Assignee: Tokyo Shibaura Denki Kabushiki Kaisha, Japan" to --[73] Assignee: Tokyo Shibaura Denki Kabushiki Kaisha, Kawasaki, Japan--.

Signed and Sealed this

*Twelfth* Day of *August 1986*

[SEAL]

*Attest:*

DONALD J. QUIGG

*Attesting Officer*

*Commissioner of Patents and Trademarks*